US011369863B2

(12) United States Patent
Yueh

(10) Patent No.: US 11,369,863 B2
(45) Date of Patent: Jun. 28, 2022

(54) BUILDING AND DEMOLITION GAME APPARATUS AND CONTROL METHOD THEREOF

(71) Applicants: Oivita Creative Co., Ltd., Taipei (TW); Chao-Yu Yueh, Taipei (TW)

(72) Inventor: Chao-Yu Yueh, Taipei (TW)

(73) Assignee: OIVITA CREATIVE CO., LTD., Taipei (TW)

( * ) Notice: Subject to any disclaimer, the term of this patent is extended or adjusted under 35 U.S.C. 154(b) by 0 days.

(21) Appl. No.: 16/392,807

(22) Filed: Apr. 24, 2019

(65) Prior Publication Data

US 2019/0344161 A1 Nov. 14, 2019

(30) Foreign Application Priority Data

May 10, 2018 (TW) ..... 107115878

(51) Int. Cl.
*A63F 9/00* (2006.01)
*A63F 9/24* (2006.01)
*A63F 9/26* (2006.01)

(52) U.S. Cl.
CPC ..... *A63F 9/0073* (2013.01); *A63F 9/24* (2013.01); *A63F 9/26* (2013.01); *A63F 2009/2442* (2013.01)

(58) Field of Classification Search
CPC ..... A63F 9/00; G01G 23/36; G01G 19/50; G06F 3/01
See application file for complete search history.

(56) References Cited

U.S. PATENT DOCUMENTS 4,457,385 A * 7/1984 Provi ..... G01G 19/44 177/256
5,611,544 A * 3/1997 Grebler ..... A63F 9/0073 273/447
2002/0134593 A1* 9/2002 Lee ..... G01G 19/44 177/245
2004/0002042 A1* 1/2004 Marcus ..... G09B 5/065 434/156

(Continued)

*Primary Examiner* — Eugene L Kim
*Assistant Examiner* — Christopher Glenn
(74) *Attorney, Agent, or Firm* — McClure, Qualey & Rodack, LLP

(57) ABSTRACT

A building and demolition game apparatus includes a base, a plurality of rectangular block elements, a monitoring unit, a game control unit and a force generating unit. The base has an assembly platform located on an upside of the base. The rectangular block elements layered to form a tower, which is stood on the assembly platform. The tower has upper and lower layers held by frictional coupling between the layers. The tower height increases during game play by removing block elements from one or more lower layers to build up successive upper layers upon the assembly platform. The monitoring unit is disposed in the base to obtain at least two boundary conditions by continuously monitoring. The game control unit is disposed in the base to generate a control signal according to a predetermined threshold and the at least two boundary conditions. The force generating unit is disposed in the base and under the assembly platform. The force generating unit is applying a force forward to the assembly platform according to the control signal generated by the game control unit.

9 Claims, 5 Drawing Sheets

(56) References Cited

U.S. PATENT DOCUMENTS

| | | | | |
|---|---|---|---|---|
| 2007/0284825 | A1* | 12/2007 | Blagg | A63F 9/0243 273/359 |
| 2014/0345954 | A1* | 11/2014 | Fukada | G01G 19/50 177/1 |
| 2016/0252390 | A1* | 9/2016 | Batsikouras | G01G 23/36 177/25.13 |
| 2017/0122794 | A1* | 5/2017 | Schmidt | G01G 19/414 |
| 2017/0160808 | A1* | 6/2017 | Hashimoto | G06F 3/016 |

* cited by examiner

BUILDING AND DEMOLITION GAME APPARATUS AND CONTROL METHOD THEREOF

CROSS REFERENCE TO RELATED APPLICATIONS

This Non-provisional application claims priority under 35 U.S.C. § 119(a) on Patent Application No. 107115878 filed in Taiwan on May 10, 2018, the entire contents of which are hereby incorporated by reference.

BACKGROUND

1. Technical Field

The invention relates to a game apparatus and its control method, in particular, to a building and demolition game apparatus and control method thereof.

2. Description of Related Art

Stacker game, also named block overlapping, is a group game invented in the early 1970s. During the game, 54 toy blocks 15:5:3 (L:W:H) (or 7.5×2.5×1.5 cm) are crisscross stacked at 3 block per layer, then the players draw out and move a lower block to the top in turn while the blocks at the highest three layers cannot be moved, and the blocks are only moved by single hand. The game over when the block stack collapses, and the player who moves the block the last time lose the game.

During the traditional stacker game, block collapse depends on the stability of the stacked structure, and limited by the rule for long term, its entertainment may be reduced for less change.

Therefore, one of the current important issues is how to provide a game apparatus, which can be used by the players like the stacker game according to their self-defined game rule to provide more entertainment.

SUMMARY OF THE INVENTION

The present invention intends to provide a building and demolition game apparatus for the players in diversified gaming methods according to their self-defined game rule, and a control method thereof.

To achieve the above object, the building and demolition game apparatus according to the present application includes a base, a plurality of rectangular block elements, a monitoring unit, a game control unit and a force generating unit. The base has an assembly platform. The rectangular block elements are stacked to form a columnar tower for mounting the assembly platform. The columnar tower has a plurality of lower layers and upper layers, and adjacent layers are stacked in alternating direction to form friction combination between layers. During gaming, the rectangular block element is moved from one of lower layers to form continuous upper layer. The monitoring unit is placed on the base corresponding to the assembly platform, and continuously performs monitoring to collect the at least two boundary conditions. The game control unit is arranged in the base and generates a control signal according to the predetermined threshold and the at least two boundary conditions. The force generating unit is arranged in base and below the assembly platform. The force generating unit applies a force on the assembly platform according to the control signal from the game control unit.

In one embodiment, the monitoring unit is a weight sensing unit which is arranged in the base corresponding to the assembly platform and outputs weight sensing information in order.

In one embodiment, the weight sensing unit includes a plurality of film pressure sensing elements, which are arranged in the base corresponding to the assembly platform and output weight sensing information according to the weight applied on the assembly platform at different times.

In one embodiment, the film pressure sensing element changes its impedance according to the weight, and outputs corresponding weight sensing information.

In one embodiment, the force generating unit is a vibration unit, an ultrasonic generating unit or an impact unit.

In one embodiment, the impact unit is arranged in the base and below the assembly platform, and the impact unit may move in the base and extend out of the assembly platform.

Additionally, to achieve the above object, the present invention provide a control method for the building and demolition game apparatus, including steps 1 to 4. Step 1 is to stack the plurality of rectangular block elements to form a columnar tower, and place the columnar tower on the assembly platform of a base; Step 2 is to set at least one predetermined threshold; Step 3 is to monitor to obtain the at least two boundary conditions; Step 4 is to judge whether the force generating unit is enabled to apply force to the rectangular block elements according to the predetermined threshold and the two boundary conditions.

In one embodiment, the boundary conditions are the weight information and obtained by regular monitoring.

In conclusion, the building and demolition game apparatus according to the present invention and the control method thereof, the rectangular block elements are stacked on the base, and a force generating unit is arranged in the base. By the predetermined threshold, the players can change the action time of the force generating unit to establish their own game rule and richen the entertainment.

The detailed technology and preferred embodiments implemented for the subject invention are described in the following paragraphs accompanying the appended drawings for people skilled in this field to well appreciate the features of the claimed invention.

BRIEF DESCRIPTION OF THE DRAWINGS

The parts in the drawings are not necessarily drawn to scale, the emphasis instead being placed upon clearly illustrating the principles of at least one embodiment. In the drawings, like reference numerals designate corresponding parts throughout the various diagrams, and all the diagrams are schematic.

DETAILED DESCRIPTION

Reference will now be made to the drawings to describe various inventive embodiments of the present disclosure in detail, wherein like numerals refer to like elements throughout.

Figure 1A:
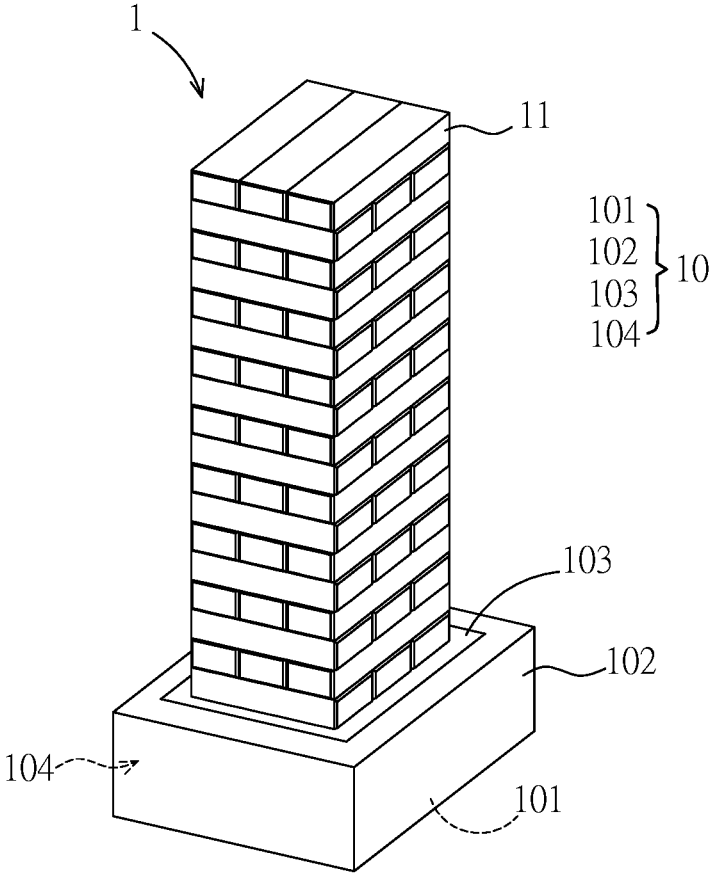
FIGS. 1A and 1B are schematic diagrams showing the structure schematic diagram of the building and demolition game apparatus according to one embodiment of the invention.
Figure 1B:
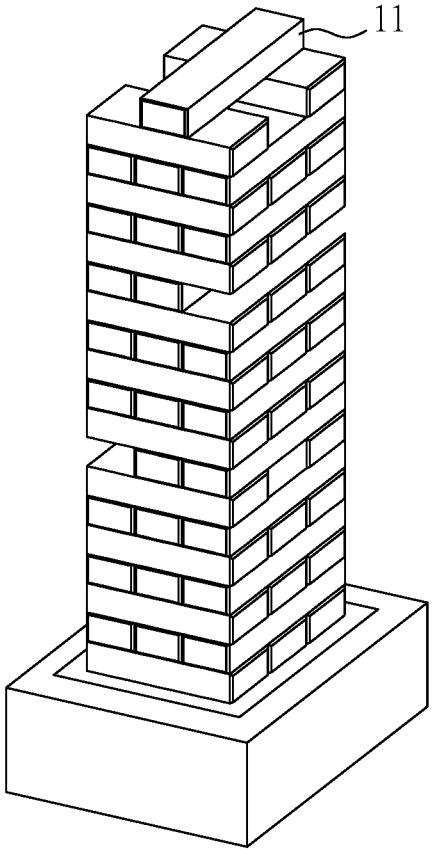
Figure 2:
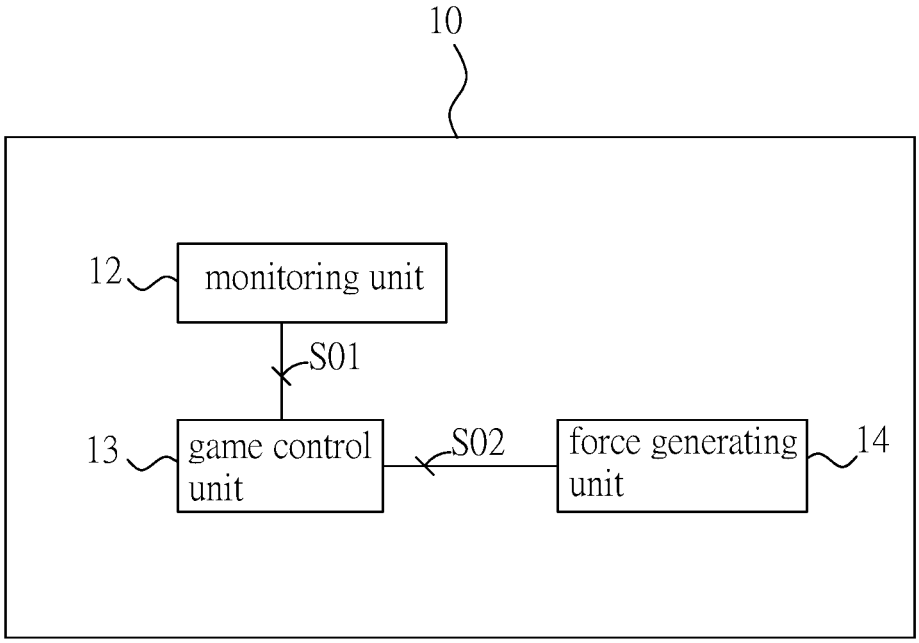
FIG. 2 is a schematic diagram showing the structural block diagram of the building and demolition game apparatus according to the embodiment of the invention.

As shown in FIG. 1A, FIG. 1B and FIG. 2, the building and demolition game apparatus (or named mountable and dismountable gaming apparatus) 1 according to the embodiment includes a base 10, a plurality of rectangular block elements 11, a monitoring unit 12, a game control unit 13 and a force generating unit 14.

The base 10 has a bottom 101, a sidewall 102 and an assembly platform 103. One side of the sidewall 102 is arranged along the periphery of the bottom 101, and the assembly platform 103 is located on another side of the sidewall 102. The bottom 101, the sidewall 102 and the assembly platform 103 constitute an accommodation space 104.

As shown in FIG. 1A and FIG. 1B, the plurality of rectangular block elements 11 is stacked to form a columnar tower, and the columnar tower is arranged on the assembly platform 103. The columnar tower includes a plurality of lower layers and upper layers, and adjacent layers are stacked in alternating direction to form friction combination between layers. During gaming, the rectangular block element 11 is moved from one of lower layers to form continuous upper layer (as shown in FIG. 1B).

Generally, there are 54 rectangular block elements 11 and with a weight of about 1 kg, so each of rectangular block elements 11 has about 18 g weight. In the embodiment, to achieve more game rules, rectangular block elements 11 may have different weight. However, in order not to impact the stability of the stacked structure, the weight difference of the rectangular block elements 11 is about 3%-35%, preferably about 5%-25% and best 5%-15%.

Figure 3:
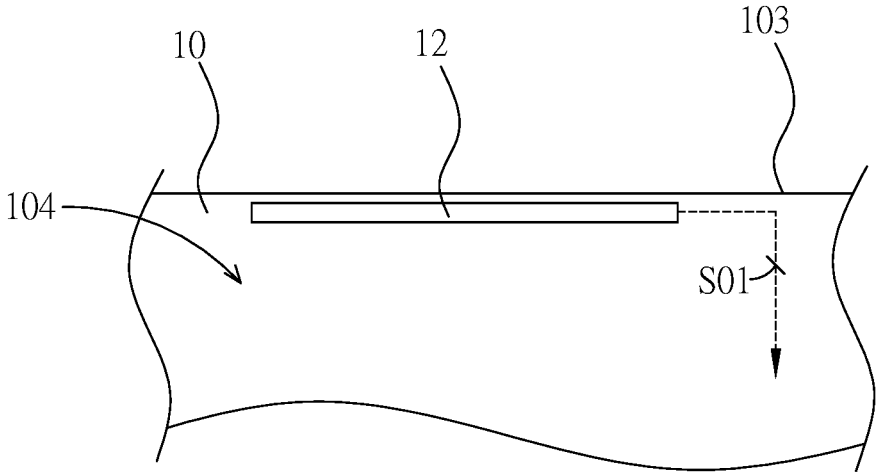
FIG. 3 is a schematic diagram showing the installation location of the monitoring unit of the building and demolition game apparatus according to the embodiment of the invention.

As shown in FIG. 3, the monitoring unit 12 is arranged in the base 10 corresponding to the assembly platform 103. The monitoring unit 12 may be a weight sensing unit, which is arranged on the side close to the accommodation space 104 corresponding to the assembly platform 103, or anther side away from the accommodation space 104. In this embodiment, the monitoring unit 12 is arranged in the accommodation space 104 of the base 10, and continuously and regularly performs monitoring to obtain the at least two boundary conditions S01.

In the embodiment, the weight sensing unit may include at least one film pressure sensing element to continuously the weights applied on the assembly platform 103, and the output the weight sensing information in order at different times. The film pressure sensing element changes its resistance according to the weight to output corresponding weight sensing information.

It can be seen from the above that each of the rectangular block elements 11 is about tens of gram heavy, and the weight difference of the rectangular block elements 11 is only about 1 g, and so the film pressure sensing element is selected to improve sensing currency. The smaller volume of the film pressure sensing element is helpful to spatial arrangement.

As shown in FIG. 1A to FIG. 2, the game control unit 13 is arranged in the base 10 and generates a control signal S02 according to the predetermined threshold and the at least two boundary conditions S01. The game control unit 13 is electrically connected with the monitoring unit 12 to obtain the boundary condition S01 regularly output from the monitoring unit 12. The boundary condition S01 is the weight sensing information. The game control unit 13 calculates and judges when the signal meet the preset predetermined threshold according to at least two of the boundary condition S01, to re-output the control signal S02. The predetermined threshold may be a numerical value or a trend curve, or set or changed by a human machine interface (not shown), or network or wireless transmission (not shown).

The force generating unit 14 is arranged in the base 10 and below the assembly platform 103. The force generating unit 14 applies the force to the assembly platform 103 according to the control signal S02 from the game control unit 13. The force generating unit 14 may be a vibrating unit, an ultrasonic generating unit or an impact unit. For example, the vibrating unit includes a vibration motor to provide vibration force to the assembly platform 103, which destroys the structure of the rectangular block elements 11 stacked on the assembly platform 103; the ultrasonic generating unit generates more than 20 KHz voice shock, which applies the force to the assembly platform 103 by liquid, gas, or solid media to destroy the structure of the rectangular block elements 11 stacked on the assembly platform 103; the impact unit can rapidly move to the assembly platform 103 by, for example, a spring, or a pneumatic or hydraulic component, and applies the force to destroy the structure of the rectangular block elements 11 stacked on the assembly platform 103.

In combination with the above, the following provides several operation methods for the building and demolition game apparatus 1. First, the players may preset the predetermined threshold by human machine interface, network or wireless transmission (e.g. Bluetooth transmission) to establish the game rule. It is assumed that the game over when the total weight of the moved rectangular block elements 11 is 150 g. During the game, the predetermined threshold is preset to 150 g, the rectangular block elements 11 are selectively stacked or not stacked on the top after removal. When the total weights of the moved rectangular block elements 11 is more than 150 g, the game control unit 13 outputs the control signal S02 and orders the force generating unit 14 to apply the force to the assembly platform 103 to destroy the structure of the rectangular block elements 11 while the game over.

Additionally, it is assumed that the game over if the weight of the moved rectangular block elements 11 is 3 g. During the game, the predetermined threshold is preset to 3 g, the rectangular block elements 11 are removed from the lower layer and stacked on the top. When the total weights of the moved rectangular block elements 11 is more than 3 g, the game control unit 13 outputs the control signal S02 and orders the force generating unit 14 to apply the force to the assembly platform 103 to destroy the structure of the rectangular block elements 11 while the game over.

Moreover, the trend curve setting may be added as the default predetermined threshold. The trend curve may be set by the players or by the game control unit 13. When the player removes the rectangular block elements 11, the player may knock on the rectangular block elements 11, and repeated verification is performed by the trend curve to ensure the procedure. Particularly, the trend curve may, for example, be a smiling curve, when the weight changes from large to small, and then big, corresponding actual action is removing and then stacking of the rectangular block elements 11. By this verification mechanism, the force generating unit 14 is not triggered by the weight changes resulting from knocking on the rectangular block elements 11, to ensure no malfunction during the game.

Figure 4:
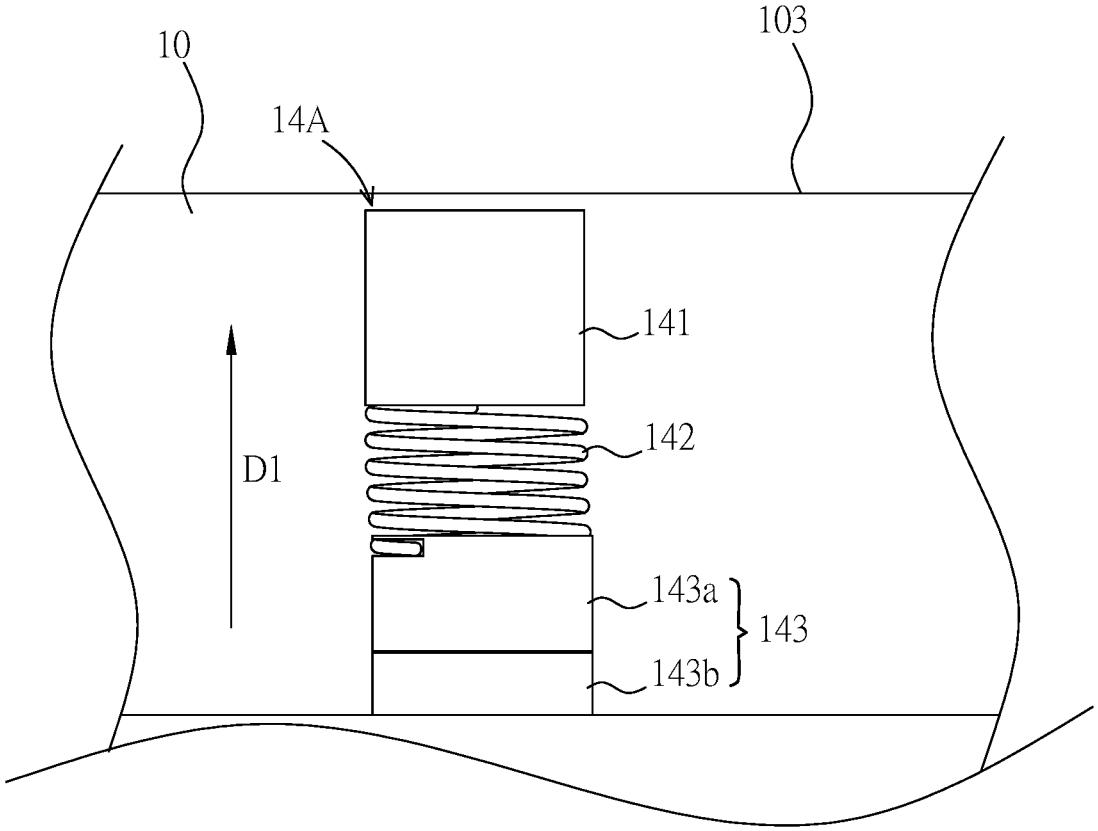
FIG. 4 is a schematic diagram showing the installation location of the force generating unit of the building and demolition game apparatus according to the embodiment of the invention.

The following further describes the embodiment of the force generating unit 14. As shown in FIG. 2 and FIG. 4, for example, the force generating unit is the impact unit 14A. The impact unit 14A is arranged in the base 10 and below the assembly platform 103, and electrically connected with the game control unit 13 to obtain the control signal S02 output from the game control unit 13.

In this embodiment, the impact unit 14A includes an impact element 141, an elastic element 142, and an electric actuation assembly 143. The impact element 141, for example, is a mass or column; the elastic element 142, for example, is a spring; the electric actuation assembly 143, for example, is an electromagnet assembly, and has a first part 143*a* and a second part 143*b*. Two ends of the elastic element 142 are respectively connected with the impact unit 14A and the first part 143*a* of the electric actuation assembly 143, and the second part 143*b* of electric actuation assembly 143 is fixed in the inner side of the base 10. The electric actuation assembly 143 can closely magnetize the first part 143*a* and the second part 143*b* after connection with the power supply. When the magnetic force disappears for disconnection of the power supply, the impact element 141 is driven by the energy accumulated in elastic element 142 to move toward assembly platform 103 along the direction D1, and finally the impact element 141 is extended out of the assembly platform 103. The power supply is controlled by the control signal S02.

The second part 143*b* of the electric actuation assembly 143 is fixed at the inner side of the base 10 by an adhesive, a clamp or a lock. The fixation method is not limited herein.

The impact unit 14A selectively is controlled by control signal S02 to selectively move in the base 10 to touch the columnar tower consisting of the rectangular block elements 11 after extension out of the assembly platform 103, (as shown in FIG. 1A or FIG. 1B), and applies the force produced during the movement to the columnar tower to destroy the structure of the rectangular block elements 11.

Additionally, in other embodiment, the force generating unit, for example, is the vibrating unit with vibration motor. The vibrating unit is arranged in the base, located blow the assembly platform, and electrically connected with the game control unit to obtain the control signal outputted from the game control unit. The vibrating unit is controlled by the control signal to drive the selective vibration of the vibration motor; the fore is applied to the assembly platform by the vibration to destroy the structure of the rectangular block elements 11.

Figure 5:
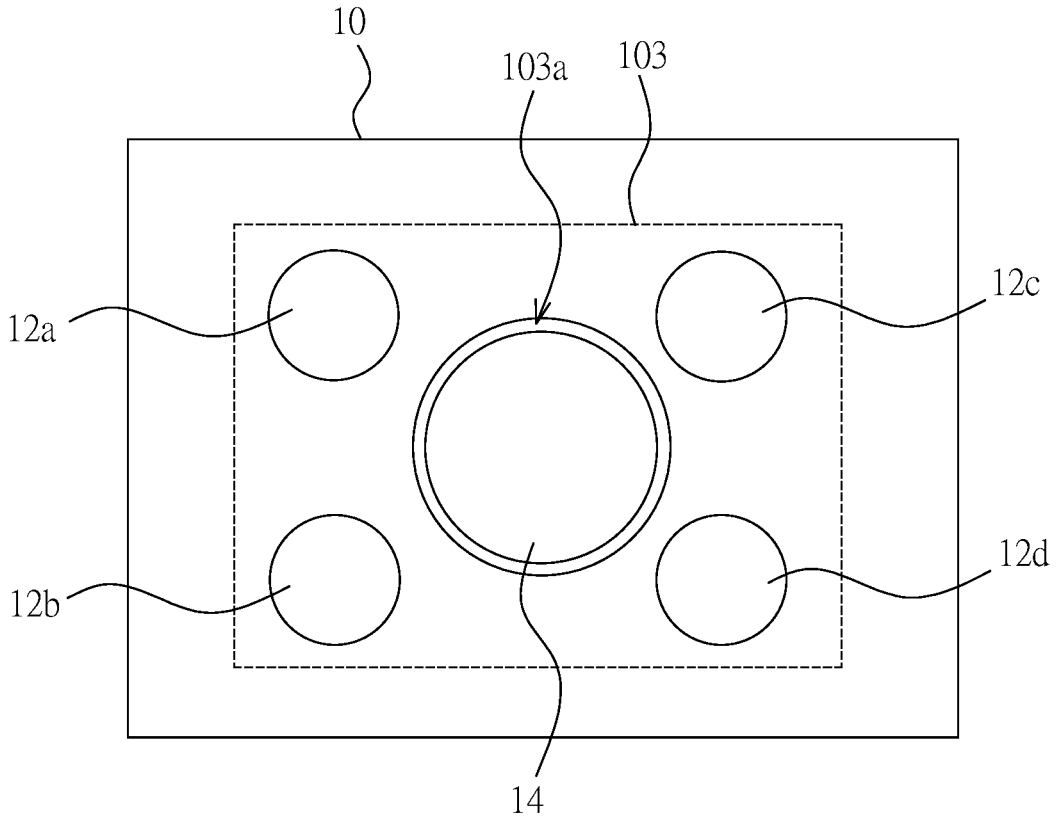
FIG. 5 is a top view showing the configuration of the building and demolition game apparatus according to the embodiment of the invention.
Figure 6:
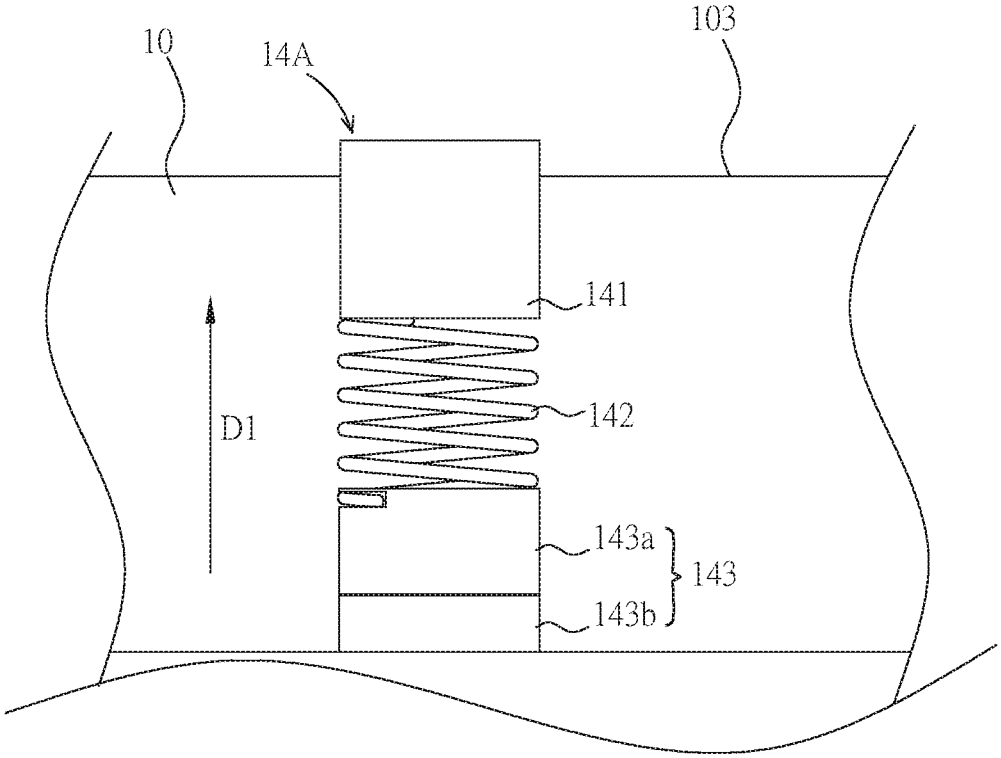
FIG. 6 is schematic diagram similar to FIG. 4, showing the impact element in an extended state.

Next, as shown in FIG. 5, the following describes the configuration of the monitoring unit 12 and the force generating unit 14 on base 10 by an example. For example, the monitoring unit 12 is the film pressure sensing element, and it may comprise a plurality of film pressure sensing elements 12*a*-12*d* which are respectively arranged on the corresponding area of the assembly platform 103. The assembly platform 103 may has an opening 103*a* for exposure of the force generating unit 14. However, the quantity and configuration of the monitoring unit 12 and the force generating unit 14 are only provided for illustration, and not limit the present invention; for example, the force generating unit 14 may be arranged close to the periphery of the assembly platform 103 to apply the fore to one side of the columnar tower.

In conclusion, the building and demolition game apparatus according to the present invention and the control method thereof, the rectangular block elements are stacked on the base, and the force generating unit is arranged in the base. By the preset predetermined threshold, the players can change the action time of the force generating unit to establish their own game rule and richen the entertainment.

Even though numerous characteristics and advantages of certain inventive embodiments have been set out in the foregoing description, together with details of the structures and functions of the embodiments, the disclosure is illustrative only. Changes may be made in detail, especially in matters of arrangement of parts, within the principles of the present disclosure to the full extent indicated by the broad general meaning of the terms in which the appended claims are expressed.

What is claimed is:

1. A building and demolition game apparatus, comprising:

a base, which has an assembly platform;

a plurality of rectangular block elements, which are stacked to form a columnar tower for mounting the assembly platform, the columnar tower has a plurality of lower layers and upper layers, and adjacent layers are stacked in alternating direction to form friction combination between layers, the rectangular block element is moved from one of lower layers to form continuous upper layer during gaming, and at least two of the rectangular block elements have different weight;

a monitoring unit, which is a weight sensing unit and placed in the base corresponding to the assembly platform, and continuously performs monitoring to collect and output at least two boundary conditions sequentially, and each of the at least two boundary conditions is a weight sensing information of the plurality of rectangular block elements;

a game control unit, which is arranged in the base and generates a control signal according to a predetermined weight threshold and the at least two boundary conditions; and a force generating unit, which is arranged in the base and below the assembly platform, and applies an impact force to the rectangular block elements according to the control signal generated from the game control unit so as to destroy structure of the columnar tower formed by the rectangular block elements, which have a weight in a range of 631.8 grams-1312.2 grams, wherein the force generating unit is an impact unit which can actively move in the base and extend out of the assembly platform.

2. The building and demolition game apparatus of claim 1, wherein the weight sensing unit includes a plurality of film pressure sensing elements, which are arranged in the base corresponding to the assembly platform and output weight sensing information according to the weight applied on the assembly platform at different times.

3. The building and demolition game apparatus of claim 2, wherein the film pressure sensing element changes its impedance according to the weight, and outputs corresponding weight sensing information.

4. The building and demolition game apparatus of claim 1, wherein a weight of each block element is in a range of 11.7 grams-24.3 grams.

5. The building and demolition game apparatus of claim 1, wherein the impact unit further comprising:

an impact element;

an elastic element having two ends, one of the end is connected to the impact unit; and an electric actuation assembly having a first part and a second part, wherein the first part is connected to another end of the elastic element, and the second part is fixed in an inner side of the base.

6. The building and demolition game apparatus of claim 5, wherein the first part and the second part of the electric actuation assembly are closely magnetized after connection with a power supply and a magnetic force disappears upon disconnection of the power supply.

7. The building and demolition game apparatus of claim 1, wherein the predetermined weight threshold is sum of the at least two boundary conditions.

8. The building and demolition game apparatus of claim 1, wherein the predetermined weight threshold is the difference between the at least two boundary conditions.

9. A building and demolition game apparatus, comprising:

a base, which has an assembly platform;

a plurality of rectangular block elements, which are stacked to form a columnar tower for mounting the assembly platform, the columnar tower has a plurality of lower layers and upper layers, and adjacent layers are stacked in alternating direction to form friction combination between layers, the rectangular block element is moved from one of lower layers to form continuous upper layer during gaming, and at least two of the rectangular block elements have different weight;

a monitoring unit, which is a weight sensing unit and placed in the base corresponding to the assembly platform, and continuously performs monitoring to collect and output at least two boundary conditions sequentially, and each of the at least two boundary conditions is a weight sensing information of the plurality of rectangular block elements;

a game control unit, which is arranged in the base and generates a control signal according to a predetermined weight threshold and the at least two boundary conditions; and a force generating unit, which is arranged in the base and below the assembly platform, and applies an impact force to the assembly platform and the rectangular block elements according to the control signal generated from the game control unit so as to destroy structure of the columnar tower formed by the rectangular block elements, which have a weight in a range of 631.8 grams-1312.2 grams, wherein the force generating unit is a vibration unit or an ultrasonic generating unit.

* * * * *